US012606946B2

(12) United States Patent
Jang et al.

(10) Patent No.: US 12,606,946 B2
(45) Date of Patent: Apr. 21, 2026

(54) DRYER

(71) Applicant: SAMSUNG ELECTRONICS CO., LTD., Suwon-si (KR)

(72) Inventors: Wonjun Jang, Suwon-si (KR); Ho Choi, Suwon-si (KR); Hyungjin Choe, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 623 days.

(21) Appl. No.: 18/102,436

(22) Filed: Jan. 27, 2023

(65) Prior Publication Data

US 2023/0175188 A1 Jun. 8, 2023

Related U.S. Application Data

(63) Continuation of application No. PCT/KR2021/008894, filed on Jul. 12, 2021.

(30) Foreign Application Priority Data

Sep. 9, 2020 (KR) ..... 10-2020-0115130

(51) Int. Cl.
*D06F 34/10* (2020.01)
*D06F 34/26* (2020.01)
(Continued)

(52) U.S. Cl.
CPC ..... *D06F 34/10* (2020.02); *D06F 34/26* (2020.02); *D06F 58/04* (2013.01); *D06F 2103/34* (2020.02)

(58) Field of Classification Search
CPC ..... D06F 34/10; D06F 34/26; D06F 58/04; D06F 2103/34
See application file for complete search history.

(56) References Cited

U.S. PATENT DOCUMENTS 6,065,170 A * 5/2000 Jang ..... D06F 39/087 68/12.27
6,643,953 B2 11/2003 Song et al.
(Continued)

FOREIGN PATENT DOCUMENTS

CN 111575992 A 8/2020
EP 0 484 607 B1 9/1994
(Continued)

OTHER PUBLICATIONS

Notice of Submission of Opinion issued Jul. 12, 2025 for Application No 10-2020-0115130.
(Continued)

*Primary Examiner* — Edelmira Bosques
*Assistant Examiner* — Bao D Nguyen
(74) *Attorney, Agent, or Firm* — STAAS & HALSEY LLP

(57) ABSTRACT

A dryer comprises: a cabinet; a drum rotatable inside the cabinet; and a hot air supply device for supplying the inside of the drum with hot air. The drum includes: a rear plate to be arranged on the rear side of the drum, the rear plate including a hot air supply hole through which hot air flows toward the drum; and a hot air supply rod protruding along a direction toward the front of the drum and through which the hot air from the hot air supply hole flows toward the drum, the hot air supply rod includes: a humidity sensor to be arranged on the front of the hot air supply rod to measure the humidity of object to be dried; and a self-generation device to generate power as a magnet rotatable with the drum rotates, to supply power generated to the humidity sensor.

15 Claims, 15 Drawing Sheets

(51) Int. Cl.
*D06F 58/04* (2006.01)
*D06F 103/34* (2020.01)

(56) References Cited

U.S. PATENT DOCUMENTS

| | | | | |
|---|---|---|---|---|
| 9,951,465 | B1 * | 4/2018 | Herschler | D06F 34/05 |
| 11,050,297 | B2 * | 6/2021 | Chiriatti | H02J 50/10 |
| 2003/0037460 | A1 * | 2/2003 | Song | D06F 58/04 34/595 |
| 2013/0025330 | A1 * | 1/2013 | Bae | D06F 37/304 310/113 |
| 2014/0182159 | A1 * | 7/2014 | Shin | D06F 58/20 34/130 |
| 2018/0106649 | A1 * | 4/2018 | Colby | G01D 5/14 |
| 2018/0266030 | A1 * | 9/2018 | Kwon | H02J 50/12 |
| 2018/0291547 | A1 * | 10/2018 | Moon | D06F 37/225 |
| 2020/0102682 | A1 * | 4/2020 | Kim | D06F 33/48 |
| 2020/0374604 | A1 * | 11/2020 | Park | D06F 58/06 |
| 2022/0064839 | A1 * | 3/2022 | Kim | D06F 34/10 |
| 2022/0396907 | A1 * | 12/2022 | Vita | B05B 17/0676 |
| 2023/0068541 | A1 * | 3/2023 | Min | D06F 58/04 |

FOREIGN PATENT DOCUMENTS

| | | | |
|---|---|---|---|
| JP | 2018-143646 | | 9/2018 |
| JP | 2019-165882 | A | 10/2019 |
| KR | 20-1989-0013396 | | 8/1989 |
| KR | 1993-0010298 | A | 6/1993 |
| KR | 1994-0015066 | A | 7/1994 |
| KR | 10-0154665 | B1 | 12/1998 |
| KR | 2000-0008887 | A | 2/2000 |
| KR | 10-0446758 | B1 | 9/2004 |
| KR | 10-2004-0090051 | A | 10/2004 |
| KR | 10-2005-0086202 | A | 8/2005 |
| KR | 10-2006-0061062 | A | 6/2006 |
| KR | 10-0698143 | B1 | 3/2007 |
| KR | 10-2007-0081371 | A | 8/2007 |
| KR | 10-0754868 | B1 | 9/2007 |
| KR | 10-0938274 | B1 | 1/2010 |
| KR | 10-2013-0092852 | A | 8/2013 |
| KR | 10-1146277 | B1 | 2/2014 |
| KR | 10-1587413 | B1 | 2/2016 |
| KR | 10-1637447 | B1 | 7/2016 |
| KR | 10-1788932 | B1 | 11/2017 |
| KR | 10-2020-0135122 | A | 12/2020 |
| KR | 10-2283175 | B1 | 7/2021 |
| WO | WO 2008-072889 | A1 | 6/2008 |

OTHER PUBLICATIONS

International Search Report issued in International Application No. dated Nov. 2, 2021.
Written Opinion issued int International Application No. PCT/KR2021/008894 Nov. 2, 2021.

* cited by examiner

DRYER

CROSS-REFERENCE TO RELATED APPLICATION

This application is a continuation application, under 35 U.S.C. § 111(a), of international application No. PCT/KR2021/008894, filed on Jul. 12, 2021, which claims priority under 35 U. S. C. § 119 to Korean Patent Application No. 10-2020-0115130, filed Sep. 9, 2020, the disclosures of which are incorporated herein by reference in their entirety.

BACKGROUND

Field

The disclosure relates to a dryer in which a structure for supplying hot air into a drum is improved.

Discussion of Related Art

In general, a dryer is a device that forcibly blows hot air into a drum to dry a substance to be dried, that is, a wet laundry placed inside the drum. Dryers are basically similar to drum washing machines in appearance, and dry a laundry by forcibly circulating hot air heated through a heater and a blowing fan into the drum.

The dryer may include a condensation type dryer and an exhaust type dryer.

In the condensation type dryer, air that has becomes humid by heat-exchange with an object to be dried inside a drum is circulated without being discharged to the outside of the dryer, and the air is subject to heat-exchange with outside air in a separate condenser to generate condensed water, which is then discharged to the outside.

In the exhaust type dryer, air that has become humid by heat exchange with an object to be dried inside a drum is directly discharged to the outside of the dryer.

Hot air supplied to the inside of the drum is supplied to the inside of the drum through a hole formed in a rear plate of the drum. In this case, when the hot air does not evenly contact the object to be dried loaded into the drum, a portion of the object to be dried may not be dried. In addition, in order to evenly dry the object to be dried, the drying time may increase.

SUMMARY

A dryer according to an embodiment of the disclosure includes: a cabinet; a drum rotatable inside the cabinet, the drum being configured to accommodate an object to be dried; and a hot air supply device configured to supply hot air into the drum, wherein the drum includes a rear plate to be arranged on a rear side of the drum, the rear plate including a hot air supply hole through which hot air supplied from the hot air supply device flows toward the drum; and a hot air supply rod protruding along a direction toward a front side of the drum and through which the hot air from the hot air supply hole flows toward the drum, wherein the hot air supply rod includes: a humidity sensor to be arranged on a front side of the hot air supply rod to measure humidity of the object which is accommodated in the drum to be dried; and a self-power generation device configured to generate power as a magnet rotatable together with the drum rotates while the drum is being rotated and to supply power generated to the humidity sensor.

The self-power generation device may include a tunnel on the front side of the hot air supply rod such that the magnet rotates along a circumference of the tunnel, and a coil along a circumference of the tunnel such that the power is generated as the magnet rotates inside the tunnel.

The tunnel may be provided to have a ring shape.

A plurality of coils including coil may be provided to be spaced apart from each other along the circumference of the tunnel.

The coil may be provided as one part along an entirety of the circumference of the tunnel.

The hot air supply rod may include a plurality of flow holes that allow the hot air supplied toward the drum to flow at 360 degrees with respect to the hot air supply rod.

The hot air supplied from the plurality of flow holes into the drum may be supplied along a circumferential direction of the hot air supply rod.

The hot air supply rod may include a housing provided on the front side of the hot air supply rod and accommodates the humidity sensor and the self-power generation device.

A printed circuit board (PCB) may be between the self-power generation device and the humidity sensor to supply the power generated by the self-power generation device to the humidity sensor.

The housing may include an opening to allow the humidity sensor to measure the humidity of the object to be dried.

The hot air supply rod may be coupleable to and detachable from the rear plate.

The hot air supply rod may include a plurality of fixing protrusions coupleable to the rear plate, and the rear plate may include a plurality of fixing holes to allow the plurality of fixing protrusions to be fixed at a circumference of the hot air supply hole.

The hot air supply rod may be coupleable to the rear plate while the plurality of fixing protrusions are inserted into the plurality of fixing holes and the hot air supply rod is rotated such that the plurality of fixing protrusions may be fixed to the plurality of fixing holes.

The dryer may further include a cover coupleable to and detachable from the rear plate to cover the hot air supply hole in a state in which the hot air supply rod may be separated from the rear plate The plurality of fixing protrusions are a plurality of first fixing protrusions and the cover may include a plurality of second fixing protrusions to be fixed to the plurality of fixing holes, and the cover may be coupleable to the rear plate while the plurality of second fixing protrusions are inserted into the plurality of fixing holes and the cover is rotated such that the plurality of second fixing protrusions may be fixed to the plurality of fixing holes.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
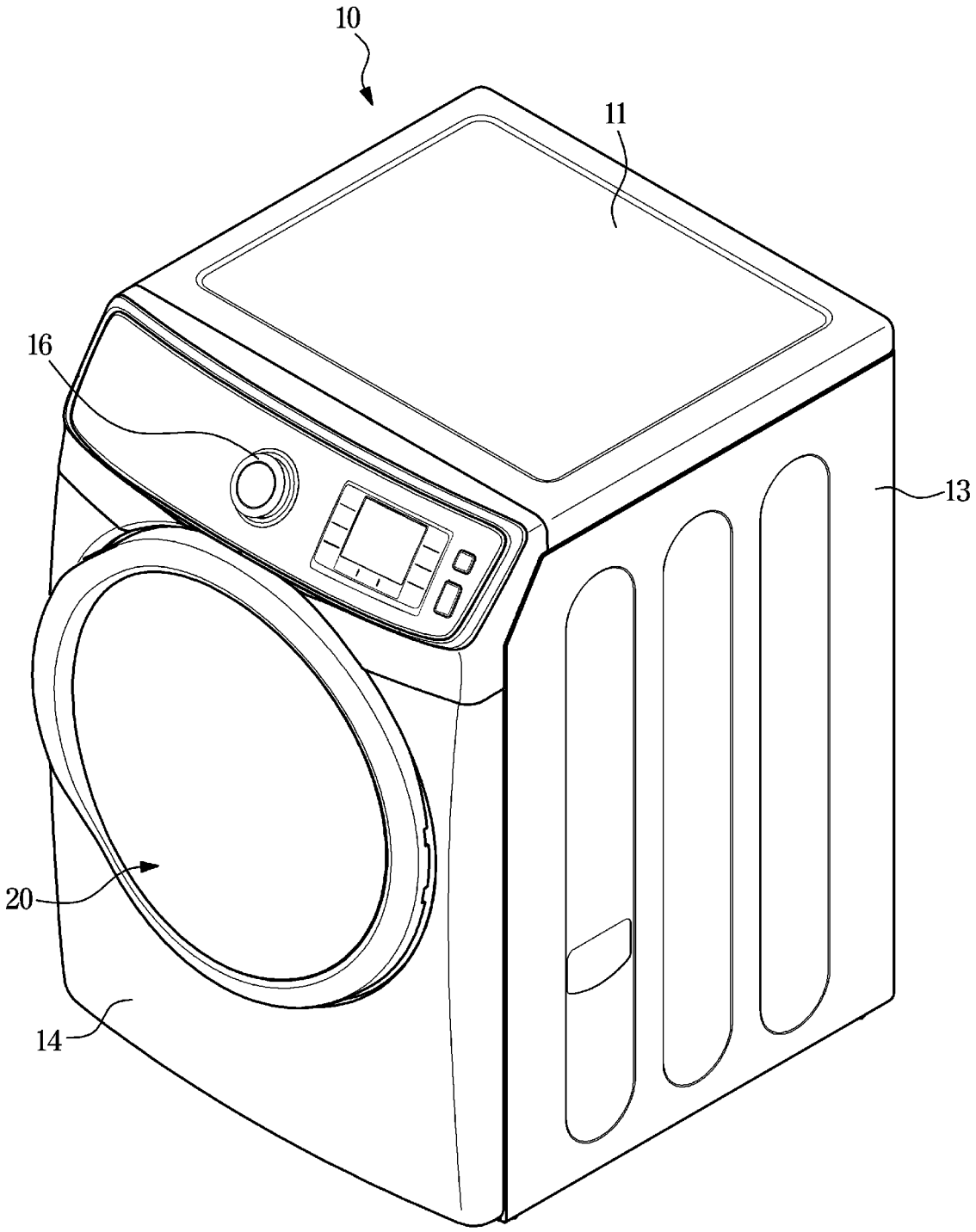
FIG. 1 is a perspective view illustrating a dryer according to an embodiment of the disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Meanwhile, the terms "front", "rear", "upper", "lower", "front", "rear", "top" and "bottom" used in the following description are defined based on drawings, and the shape and position of each component are not limited by the terms.

One aspect of the disclosure provides a dryer that is improved so that hot air may evenly come in contact with an object to be dried inside a drum.

In addition, a dryer in which a humidity sensor for measuring the humidity of an object to be dried is located inside a drum to accurately measure the humidity of an object to be dried is provided.

In addition, a dryer that is capable of generating power by self-generation during a rotation of a drum and supplying power to a humidity sensor is provided.

According to the embodiments of the disclosure, the dryness level can be improved, and the drying time can be shortened.

Hereinafter, embodiments according to the disclosure will be described in detail with reference to the accompanying drawings.

Figure 2:
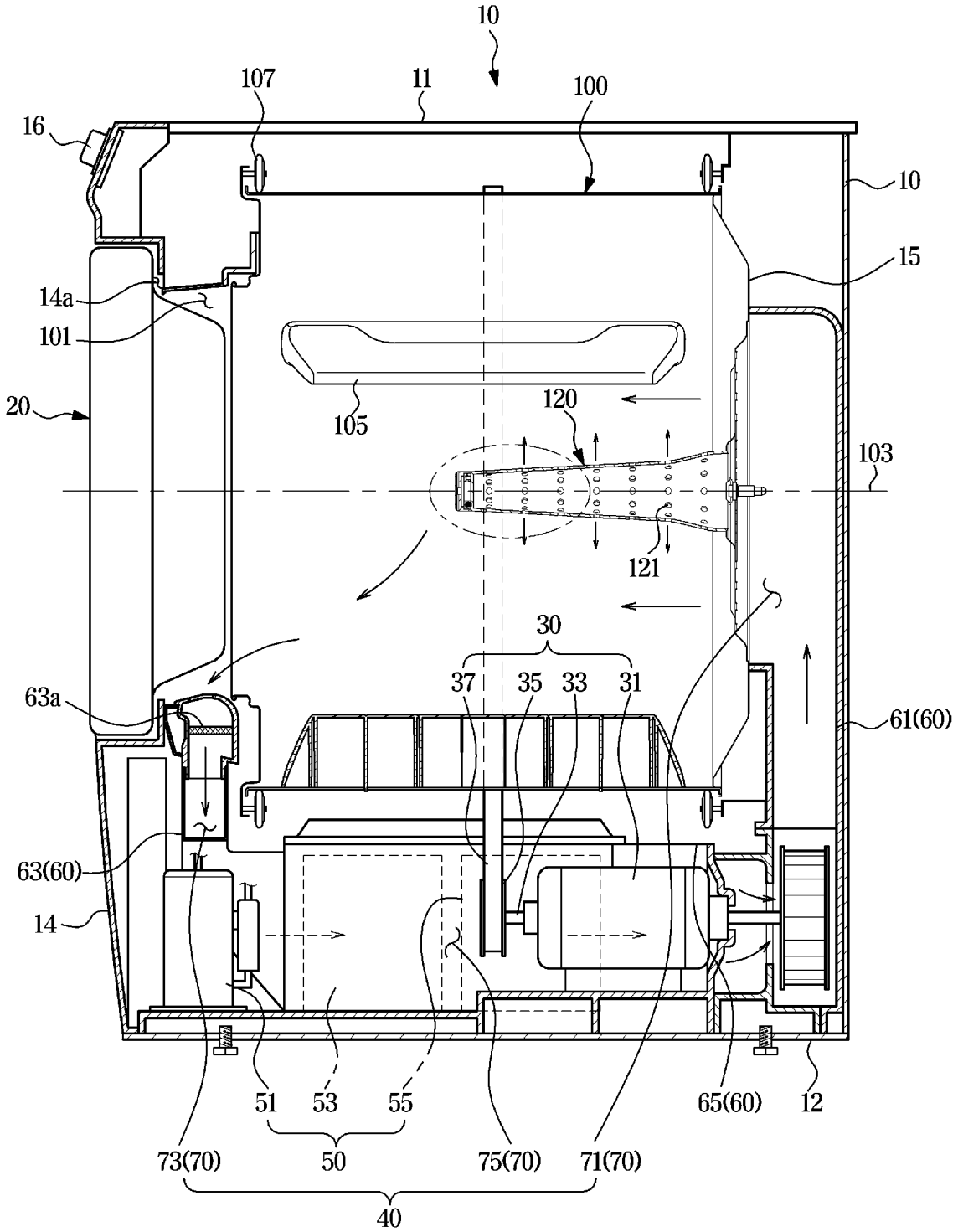
FIG. 2 is a side cross-sectional view illustrating a dryer according to an embodiment of the disclosure.

FIG. 1 is a perspective view illustrating a dryer according to an embodiment of the disclosure. FIG. 2 is a side cross-sectional view illustrating a dryer according to an embodiment of the disclosure Referring to FIGS. 1 and 2, a dryer may include a cabinet 10 forming the external appearance, a drum 100 rotatably provided inside the cabinet 10 and accommodating an object to be dried therein, a door 20 configured to open and close an inlet 14*a* formed in the cabinet 10, a driving device 30 provided to rotate the drum 100, and a hot air supply device 40 for supplying hot air to the inside of the drum 100.

The cabinet 10 may have a substantially box shape. Specifically, the cabinet 10 may include a top plate 11, a bottom plate 12, a left side plate (not shown), a right side plate 13, a front cabinet 14, and a rear cabinet 15. In the embodiment, the left side plate, the right side plate 13 and the rear cabinet 15 may be integrally formed with each other, but are not limited thereto and may be separately formed and assembled to each other.

The front cabinet 14 of the cabinet 10 may have the inlet 14*a* through which an object to be dried is introduced to or withdrawn from the inside of the drum 100. A drying object inlet 101, which will be described below, may be formed on a front side of the drum 100 to correspond to the inlet 14*a*. That is, the drying object inlet 101, which will be described below, may be formed on the front side of the drum 100 to communicate with the inlet 14*a*.

The front cabinet 14 may be provided at an upper portion with a control panel 16 capable of displaying various types of information about the dryer or inputting operation commands.

The drum 100 may be provided inside the cabinet 10 to accommodate an object to be dried. The drum 100 may be rotatably provided inside the cabinet 10. The drum 100 may be rotated by receiving power from the driving device 30.

The drum 100 may be provided in a substantially cylindrical shape having a front side that is open. The opening formed on the front side of the drum 100 may be the drying object inlet 101 communicating with the inlet 14*a*. An object to be dried may be inserted into or withdrawn from the drum 100 through the inlet 14*a* and the drying object inlet 101. The drum 100 may be provided inside the cabinet 10 to be rotatable around a rotating axis 103. A lifter 105 may be formed on an inner circumferential surface of the drum 100 to lift the object to be dried when the drum 100 rotates. As the drum 100 rotates, the object to be dried may be raised and then dropped by the lifter 105 repeatedly. A roller 107 supporting the drum 100 for smooth rotation may be provided on an outer circumferential surface of the drum 100. A rear plate 110 may be provided on the rear side of the drum 100. The rear plate 110 may be provided with a hot air supply hole 111 and a plurality of discharge holes 113 for supplying hot air supplied from the hot air supply device 40 to the inside of the drum 100. In addition, on the rear plate 110 of the drum 100, a hot air supply rod 120 provided to communicates with the hot air supply hole 111 (see FIG. 4) to supply the hot air from the hot air supply device 40 to the inside of the drum 100 may be provided. Detailed descriptions of the hot air supply rod 120 will be described below.

The door 20 may be provided to open and close the inlet 14*a* formed on the front side of the cabinet 10. The door 20 may be rotatably installed on the front cabinet 14 of the cabinet 10.

The driving device 30 may be provided to rotate the drum 100.

The driving device 30 may be disposed on an inner lower portion of the cabinet 10. The driving device 30 may include a drive motor 31 having a rotation shaft 33, and a pulley 35 and a belt 37 for transmitting power of the drive motor 31 to the drum 20. The pulley 35 may be connected to the drive motor 31 by the rotation shaft 33. When the rotation shaft 33 is rotated by the driving motor 31, the pulley 35 may also be rotated together with the rotation shaft 33. The belt 37 may be installed to be wound around the outer surface of the pulley 35 and the outer surface of the drum 20. When the belt 37 is rotated by a driving force of the driving motor 31, the drum 20 may be rotated together with the belt 37.

The hot air supply device 40 may be provided to supply hot air into the drum 100. The hot air supply device 40 may include a heat pump 50 for producing hot air and a duct 60 forming a flow path 70 that guides the hot air generated by the heat pump 50 to the inside of the drum 100.

The heat pump 50 may include a compressor 51, an evaporator 53, a condenser 55, and an expansion valve (not shown). The heat pump 50 may be provided in which a circulating refrigerant cools high-temperature cold air, removing the moisture, and the air is heated again and then supplied to the inside of the drum 100.

The duct 60 may include a hot air supply duct 61 for guiding hot air to the drum 100, a hot air discharge duct 63 for discharging hot air having passed through the inside of the drum 100, and a connection duct 65 connecting the hot air supply duct 61 and the hot air discharge duct 63.

The flow path 70 may include a hot air supply flow path 71 formed by the hot air supply duct 61 to supply hot air to the inside of the drum 100, a hot air discharge flow path 63 provided to discharge hot air having passed through the inside of the drum 100, and a connection flow path 75 connected to the hot air discharge flow path 73 and connecting the hot air discharge duct 63 and the hot air supply duct 61. The connection flow path 75 may accommodate the evaporator 53 and the condenser 55 of the heat pump 50.

The duct 60 may be provided on the bottom plate 12 provided on the lower side of the drum 100. The hot air discharge duct 63 may be disposed at a front lower side of the drum 100. The hot air supply duct 61 may be disposed behind the drum 100. The connection duct 65 may be disposed on a lower side of the drum 100. The connection duct 65 may be installed on the bottom plate 12.

The hot air supply duct 61 may be disposed behind the drum 100. Hot dry air may be supplied to the inside of the drum 100 by the hot air supply duct 61, and an object to be dried inside the drum 100 may be dried by the hot dry air. The air having dried the object to be dried may become hot and humid, and the hot and humid air inside the drum 100 may be discharged to the outside of the drum 100 through the hot air discharge duct 63.

A filter 63*a* may be installed in the hot air discharge duct 63 so that foreign substances, such as lint contained in the hot air passed through the drum 100, may be filtered out. Air discharged through the hot air discharge duct 63 may be introduced into the connection duct 65.

The hot and humid air introduced into the connection duct 65 through the hot air discharge duct 63 may be guided to the evaporator 53 so that moisture in the hot and humid air may be removed. The air having moisture removed by the evaporator 53 may be heated to a high temperature by the condenser 55 and supplied to the inside of the drum 100 back through the hot air supply duct 61.

The rear plate 110 of the drum 100 may include a hot air supply hole (111, see FIG. 4) formed in the central portion of the rear plate 110, and a plurality of discharge holes 113 formed along a circumference of the hot air supply hole 111. The hot air supply hole 111 and the plurality of discharge holes 113 may communicate with the hot air supply duct 61. Therefore, a portion of hot air guided to the hot air supply duct 61 by the hot air supply device 40 may be discharged into the drum 100 through the plurality of discharge holes 113, and a remaining portion may be transferred to the hot air supply rod 120 through the hot air supply hole 111.

The hot air supply rod 120 may be provided on the front side of the rear plate 110 of the drum 100 to protrude in a direction toward the front side of the drum 100 while communicating with the hot air supply hole 111. The hot air supply rod 120 may be provided to supply hot air into the drum 100. Hot air supplied through the hot air supply device 40 may be transferred to the hot air supply rod 120 through the hot air supply hole 111.

The hot air supply rod 120 may include a plurality of flow holes 120 that allow hot air supplied to the inside of the drum 100 to flow at 360 degrees with respect to the hot air supply rod 120. The hot air supplied into the drum 100 through the plurality of flow holes 121 may be supplied in a circumferential direction of the hot air supply rod 120.

Therefore, a portion of the hot air guided to the hot air supply duct 61 by the hot air supply device 40 may be supplied in the axial direction of the hot air supply rod 120 through the plurality of discharge holes 113 formed in the rear plate 110, to dry the object to be dried. A remaining portion of the hot air guided to the hot air supply duct 61 by the hot air supply device 40 may be transferred to the hot air supply rod 120 through the hot air supply hole 111 formed in the rear plate 110, in which the hot air supplied to the inside of the drum 10 through the plurality of flow holes 121 may be supplied in the circumferential direction of the hot air supply rod 120, to dry the object to be dried. That is, since hot air is supplied to the inside of the drum 100 in the axial direction and the circumferential direction of the hot air supply rod 120, an object to be dried accommodated inside the drum 100 may have a larger contact arear with hot air. With such a configuration, all parts of the object to be dried may be evenly dried, and the drying efficiency may be improved.

Figure 3:
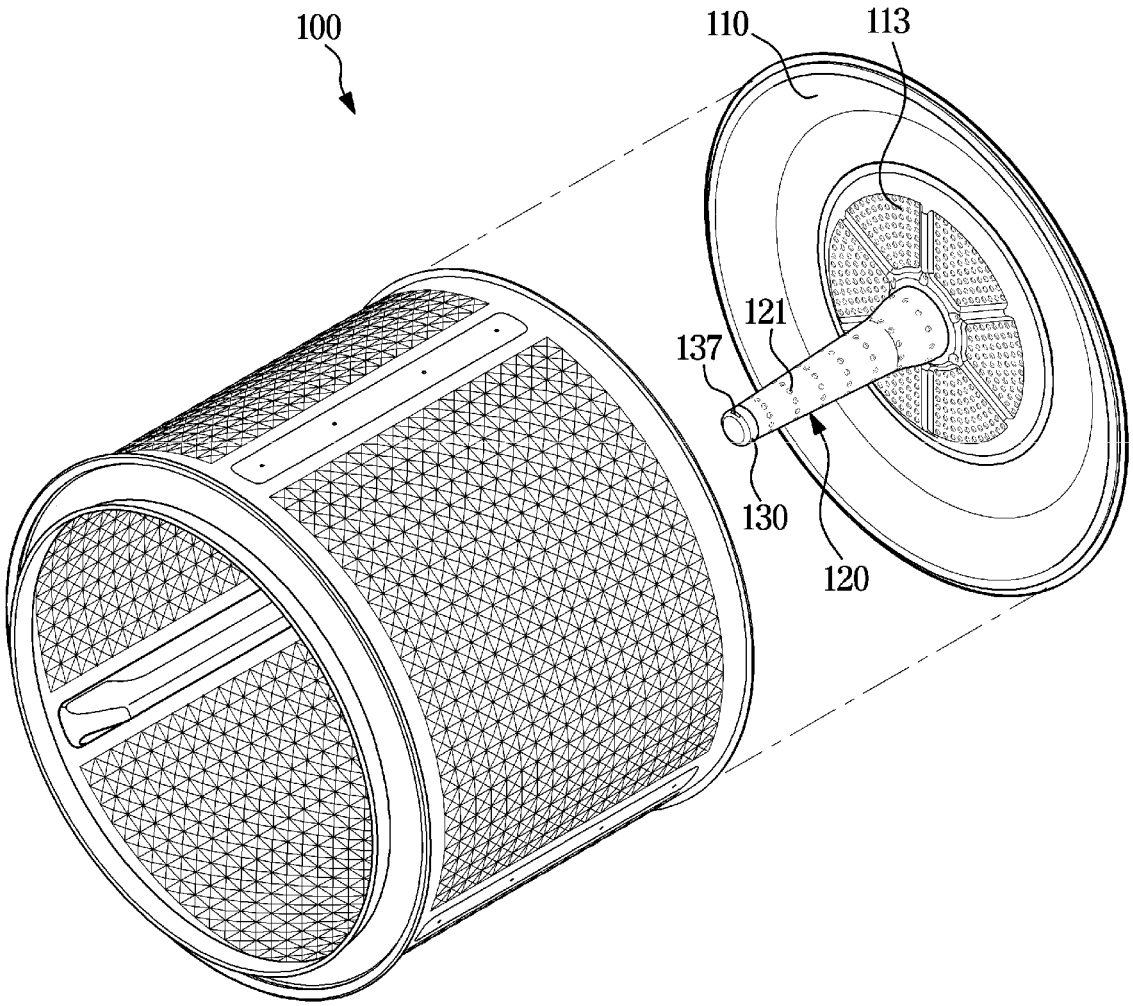
FIG. 3 is a view illustrating a state in which a rear plate is separated from a drum according to an embodiment of the disclosure.
Figure 4:
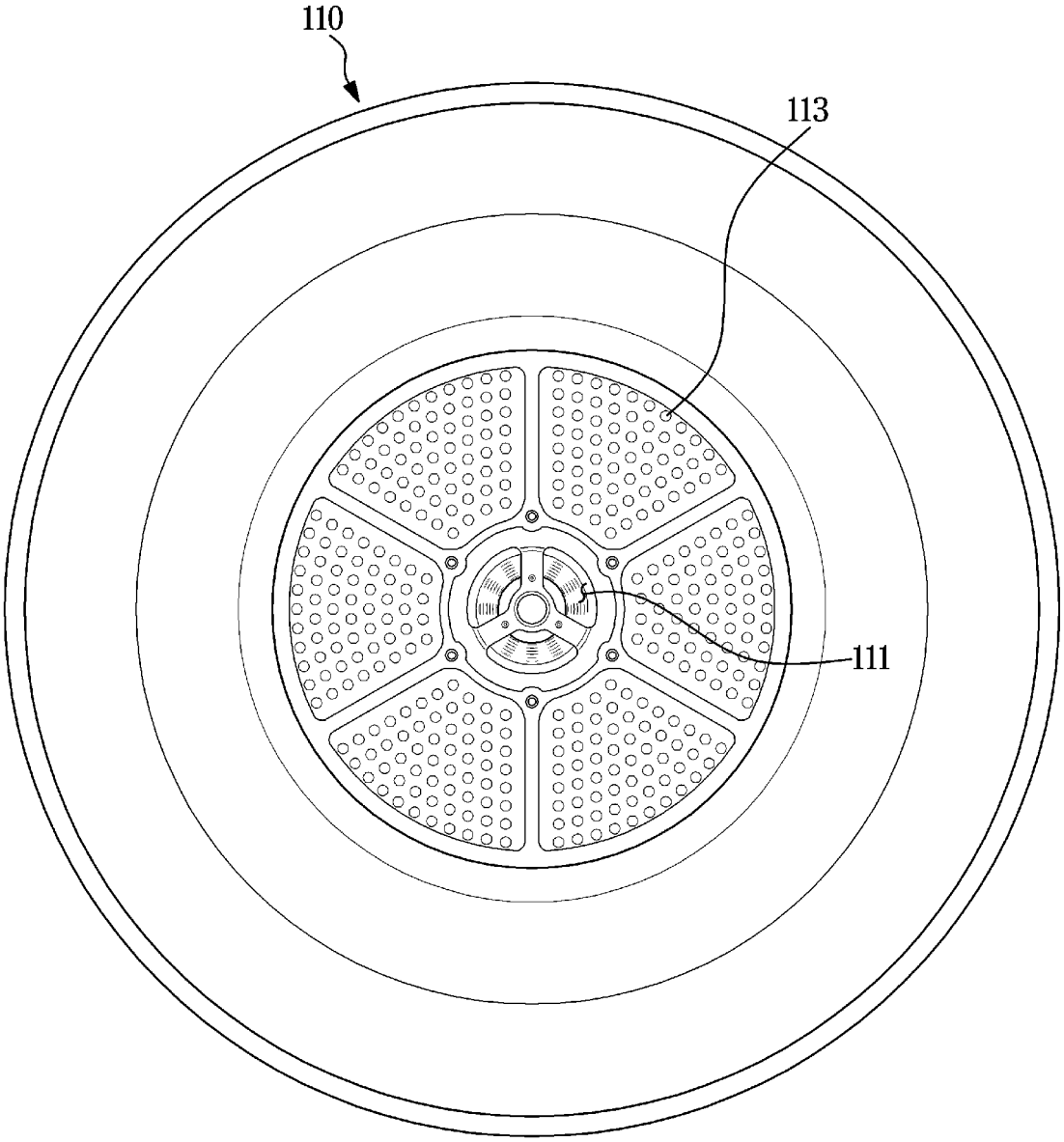
FIG. 4 is a view illustrating a rear side of a rear plate according to one embodiment of the disclosure.
Figure 5:
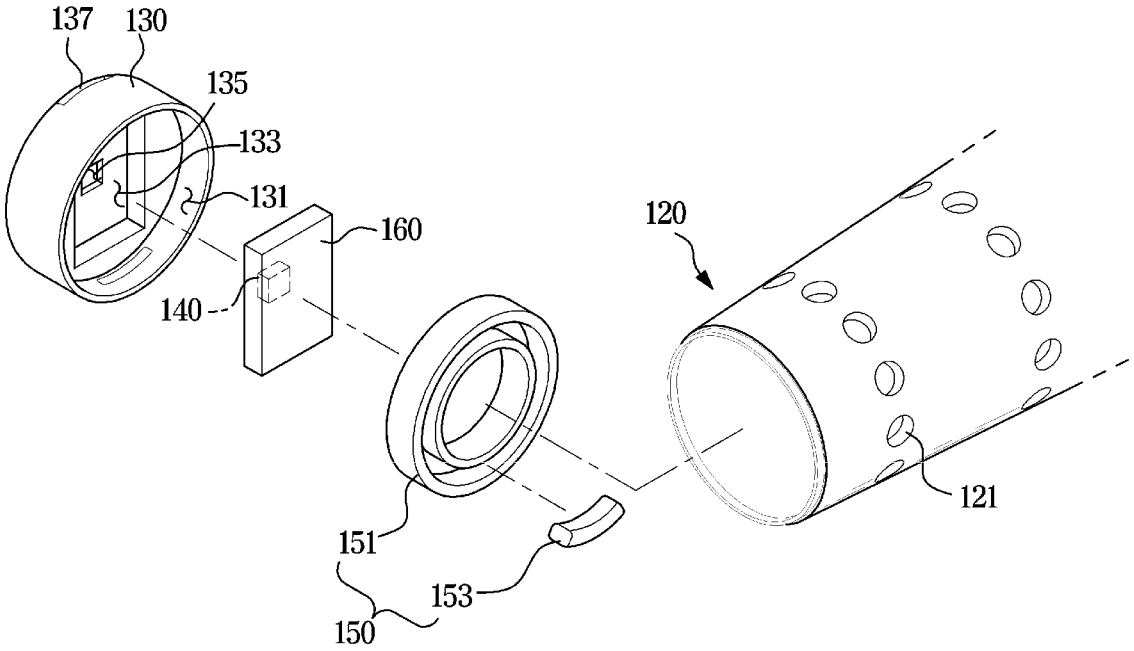
FIG. 5 is a view illustrating a state in which a housing, a humidity sensor, a self-power generation device, and a printed circuit board (PCB) are separated from a hot air supply rod according to an embodiment of the disclosure.
Figure 6:
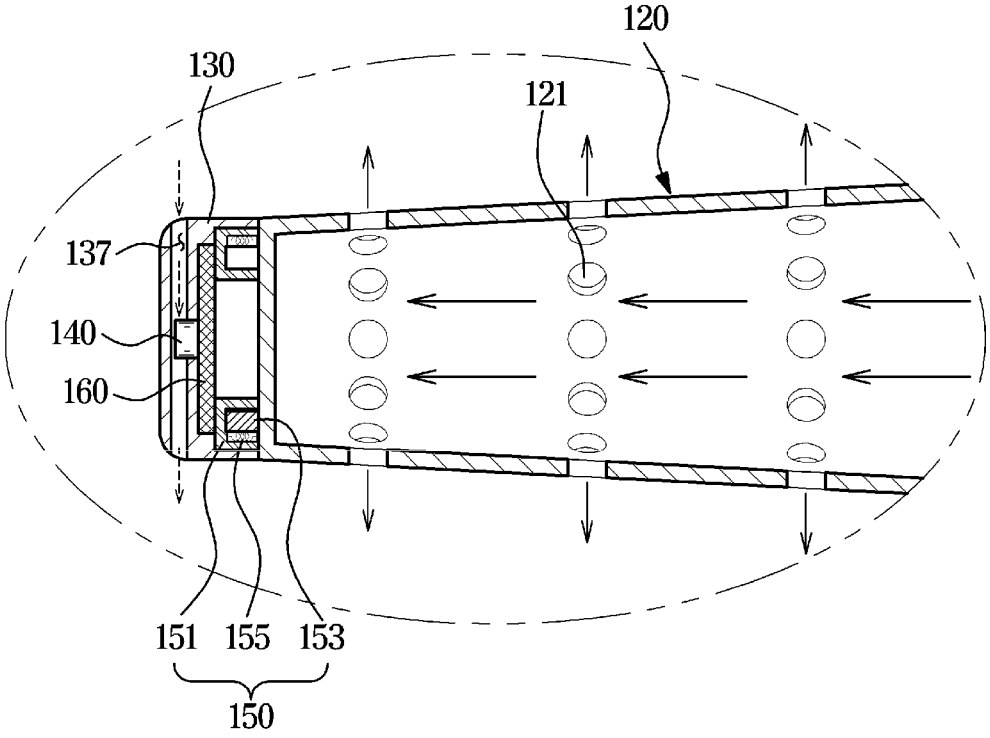
FIG. 6 is an enlarged view of part A of FIG. 2 according to an embodiment of the disclosure.
Figure 7:
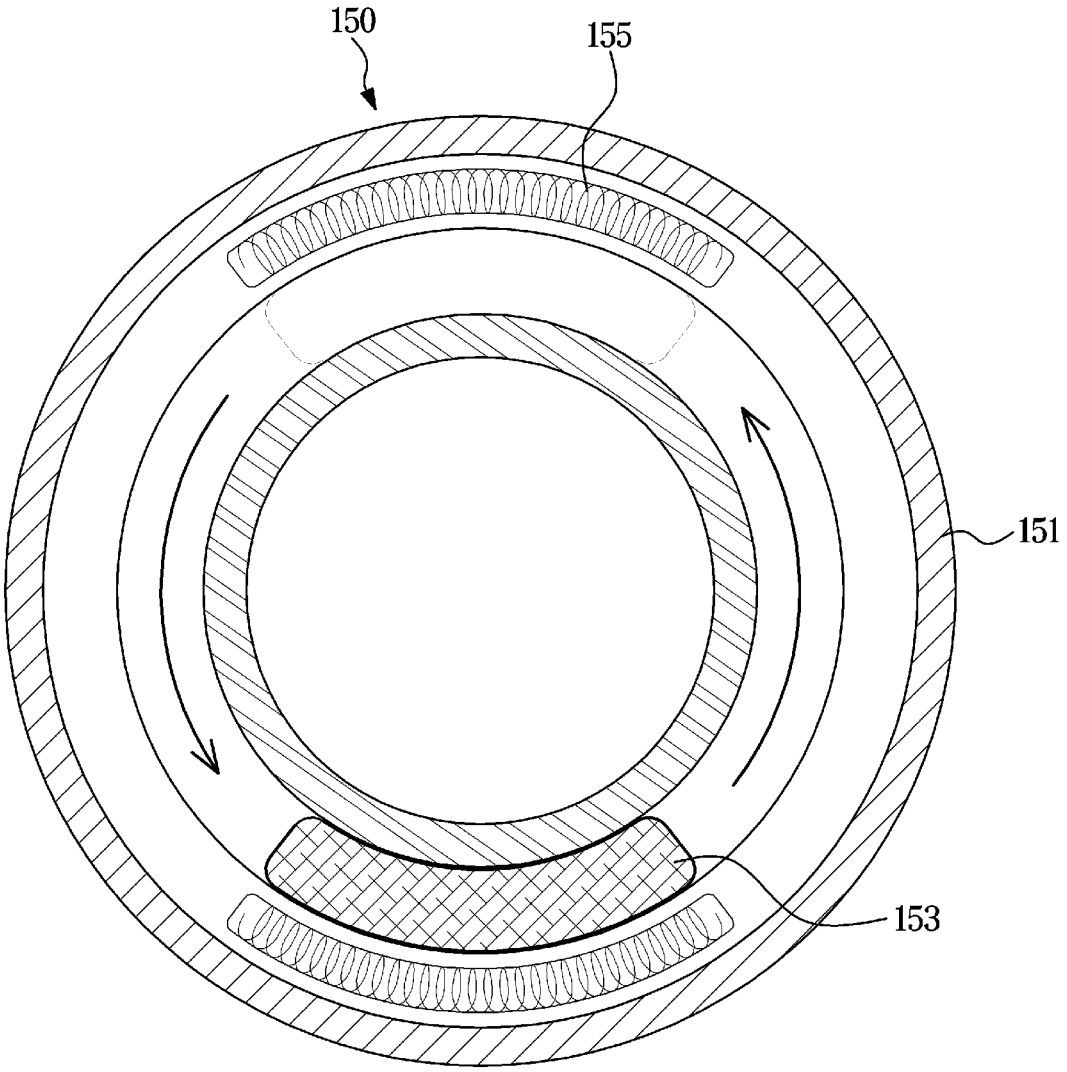
FIG. 7 is a view illustrating a process in which a magnet rotates inside a tunnel during a rotation of a drum according to an embodiment of the disclosure.

FIG. 3 is a view illustrating a state in which a rear plate is separated from a drum according to an embodiment of the disclosure. FIG. 4 is a view illustrating a rear side of a rear plate according to one embodiment of the disclosure. FIG. 5 is a view illustrating a state in which a housing, a humidity sensor, a self-power generation device, and a printed circuit board (PCB) are separated from a hot air supply rod according to an embodiment of the disclosure. FIG. 6 is an enlarged view of part A of FIG. 2. FIG. 7 is a view illustrating a process in which a magnet rotates inside a tunnel when a drum rotates according to an embodiment of the disclosure.

Referring to FIGS. 3 to 7, the hot air supply rod 120 may be provided to protrude on the front side of the rear plate 120 of the drum 100. The hot air supply rod 120 may supply hot air into the drum 100. The hot air supply rod 120 may communicate with the hot air supply hole 111 formed in the rear plate 120.

The hot air supply rod 120 may include a housing 130 provided on a front side of the hot air supply rod 120. The housing 130 may be provided to accommodate a humidity sensor 140, a self-power generation device 150, and a printed circuit board (PCB) 160 therein. The housing 130 includes a first accommodating part 131 in which the self-power generation device 150 is accommodated, a second accommodating part 133 in which the PCB 160 is accommodated, a third accommodating part 135 in which the humidity sensor 140 is accommodated, and a plurality of openings 137. The plurality of openings 137 may be provided so that the humidity sensor 140 accommodated inside the housing 130 may measure the humidity of the object to be dried stored inside the drum 100.

The hot air supply rod 120 may include the humidity sensor 140 accommodated inside the housing 130 to measure the humidity of the to-be dried object stored inside the drum 100. The humidity sensor 140 may be provided to measure the humidity of the to-be dried object inside the drum 100. Since the humidity sensor 140 is accommodated inside the housing 130 provided on the front side of the hot air supply rod 120, the humidity sensor 140 may be located inside the drum 100. Since the humidity sensor 140 is located inside the drum 100 and directly measures the humidity of the to-be dried object stored in the drum 100, the humidity of the to-be dried object may be more accurately measured.

The hot air supply rod 120 may include the self-power generation device 150 that is accommodated inside the housing 130 and supplying power to the humidity sensor 140. The self-power generation device 150 may be provided to supply the humidity sensor 140 with power so that the humidity sensor 140 may measure the humidity of the to-be dried object accommodated inside the drum 100. The self-power generation device 150 may be accommodated inside the housing 130 and provided to generate power when the drum 100 rotates.

The self-power generation device 150 may include a tunnel 151 provided to have a ring shape on the front side of the hot air supply rod 120, a magnet 153 provided to be movable inside the tunnel 151 so as to rotate along the tunnel 151 inside the tunnel 151 when the drum 100 rotates, and a coil 155 provided at a circumference of the tunnel 151 such that power is produced as the magnet 153 rotates inside the tunnel 151. The coil 155 may be provided as a plurality of coils to be spaced apart from each other along the circumference of the tunnel 151. Two coils 155 are illustrated in the drawings, but the disclosure is not limited thereto, and three or more coils may be provided, or one coil may be provided.

Since the magnet 153 is movably provided inside the ring-shaped tunnel 151, when the drum 100 rotates, the magnet 153 may rotate along the tunnel 151 inside the tunnel 151. Since the coils 155 are provided along a circumference of the tunnel 151, when the magnet 153 rotates inside the tunnel 151, the self-power generation device 150 may generate power. That is, the self-power generation device 150 may generate power by itself when the drum 100 rotates without a separate device. The power generated by the self-power generation device 150 may be supplied to the humidity sensor 140.

The hot air supply rod 120 may include a PCB 160 provided between the humidity sensor 140 and the self-power generation device 150 such that the power generated by the self-power generation device 150 is supplied to the humidity sensor 140. The PCB 160 may allow power generated by the self-power generation device 150 during rotation of the drum 100 to be supplied the humidity sensor 140.

Figure 8:
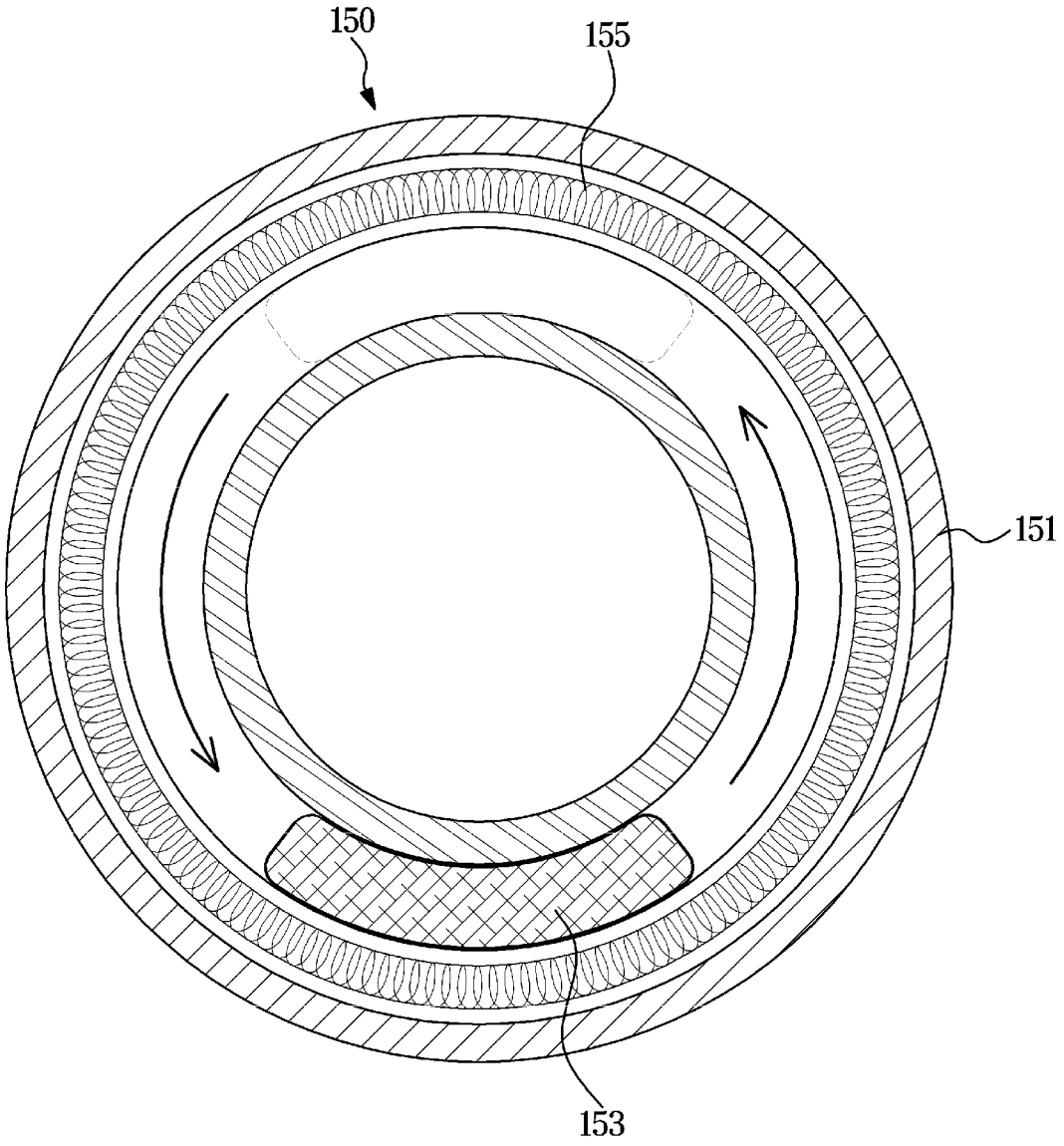
FIG. 8 is a view illustrating a process in which a magnet rotates inside a tunnel during a rotation of a drum according to another embodiment of the disclosure.

FIG. 8 is a view illustrating a process in which a magnet rotates inside a tunnel when a drum rotates according to another embodiment of the disclosure.

Referring to FIG. 8, the coil 155 may be provided as one part along the entire circumference of the tunnel 151.

Figure 9:
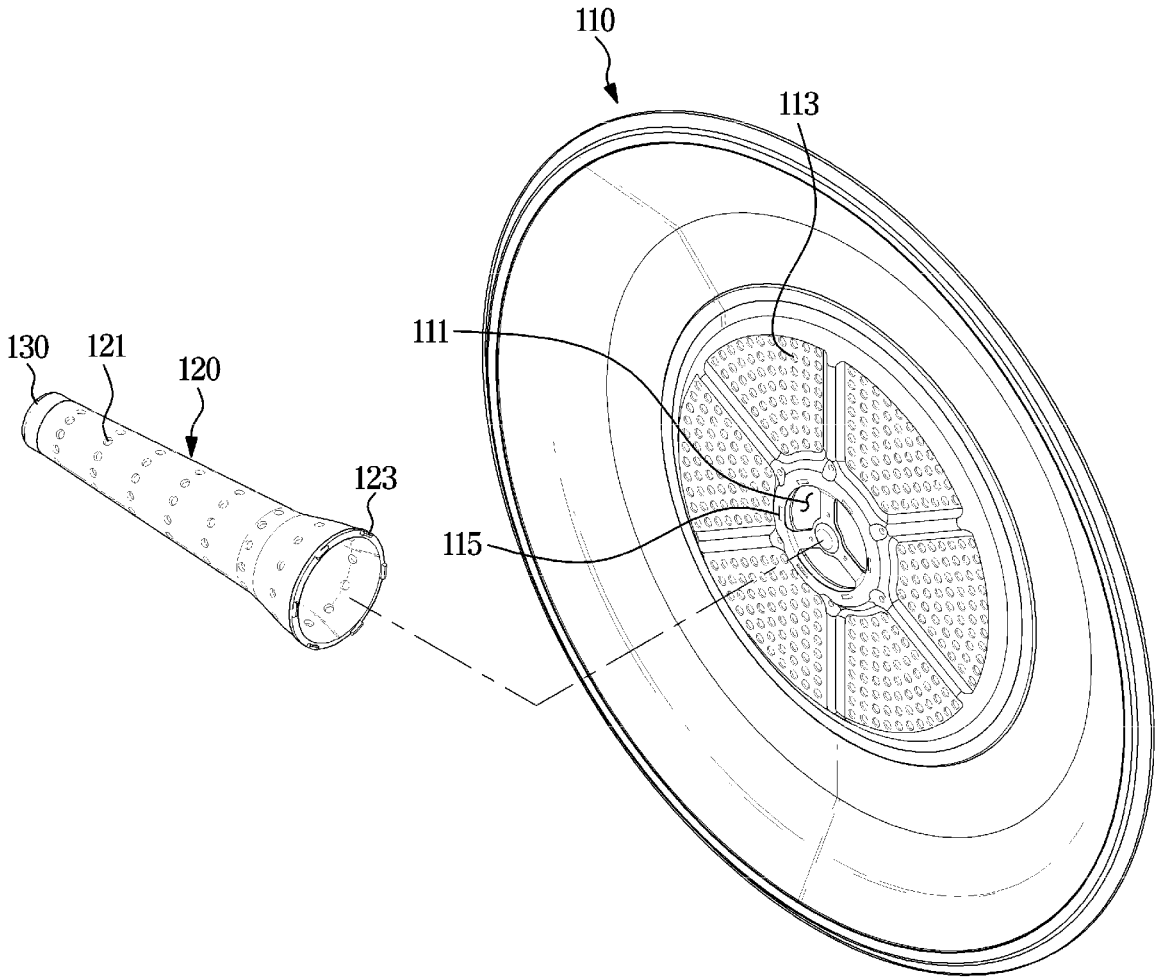
FIG. 9 is a view illustrating a process in which a hot air supply rod is coupled to a rear plate of a drum according to another embodiment of the disclosure.
Figure 10:
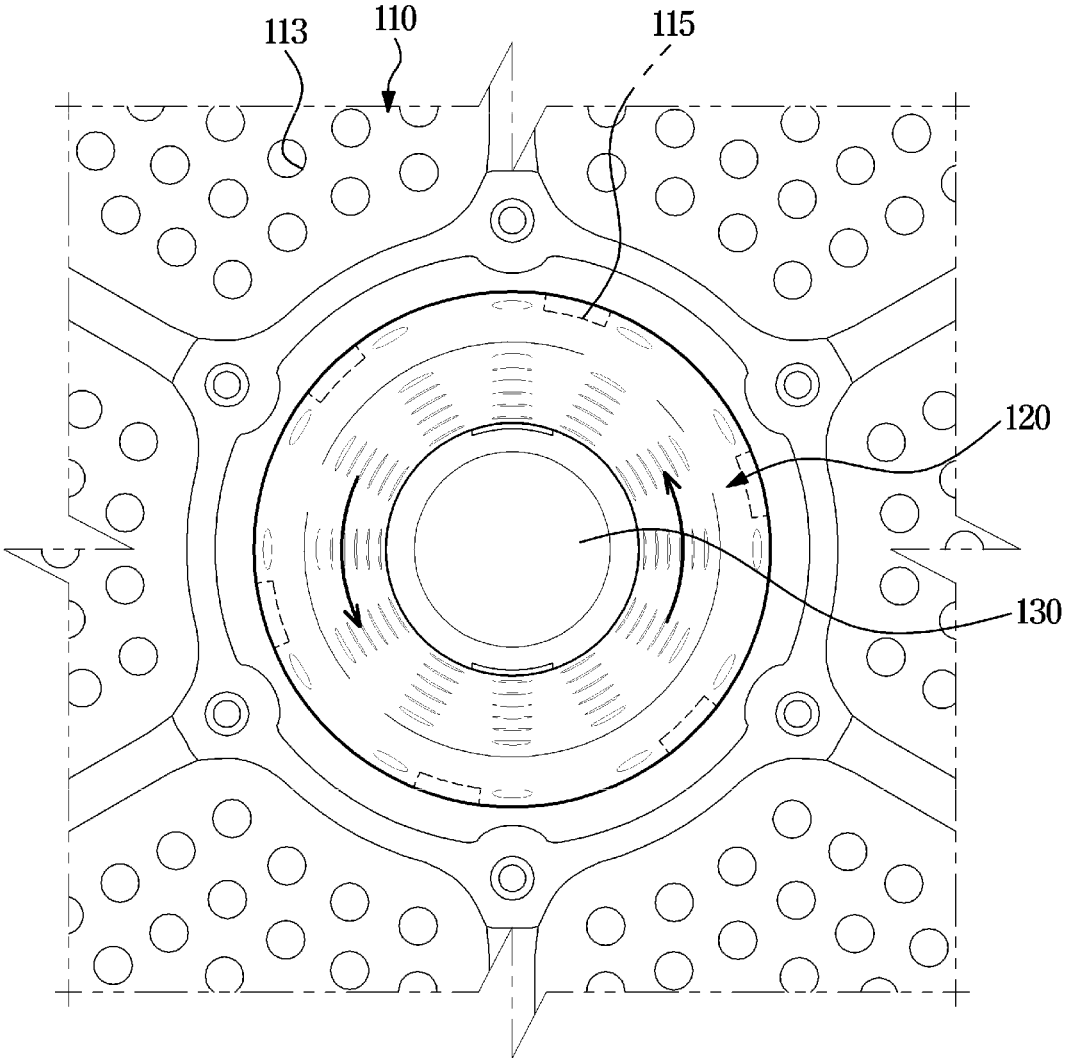
FIG. 10 is a view illustrating a process in which a hot air supply rod is rotated to be coupled to a rear plate of a drum according to another embodiment of the disclosure.
Figure 11:
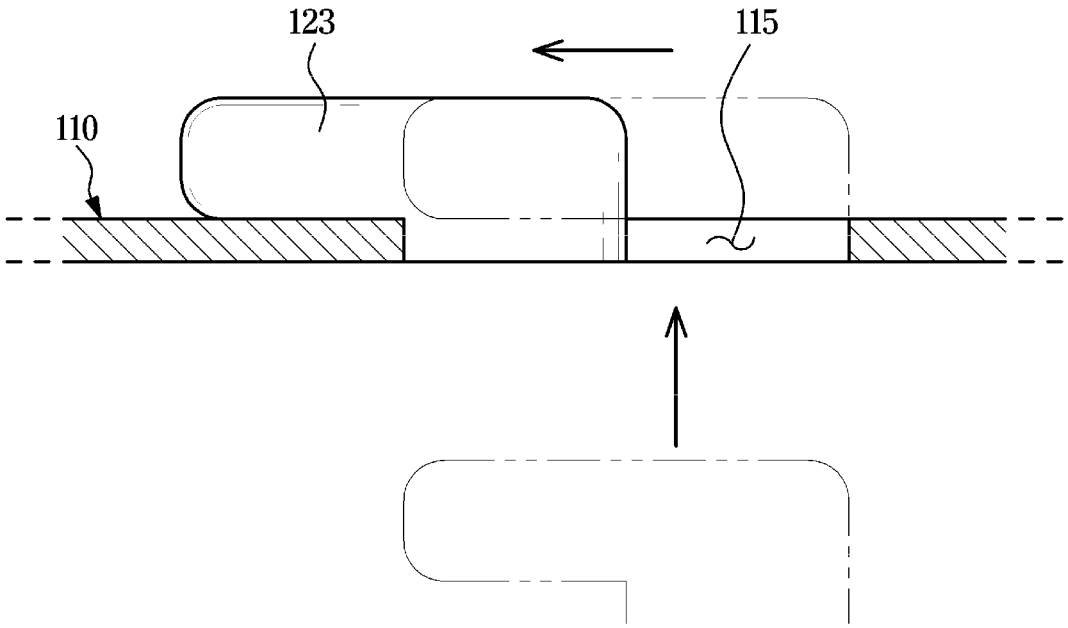
FIG. 11 is a view illustrating a process in which a first fixing protrusion of a hot air supply rod is inserted into a plurality of fixing holes formed on a rear plate and then rotated to be fixed according to another embodiment of the disclosure.
Figure 12:
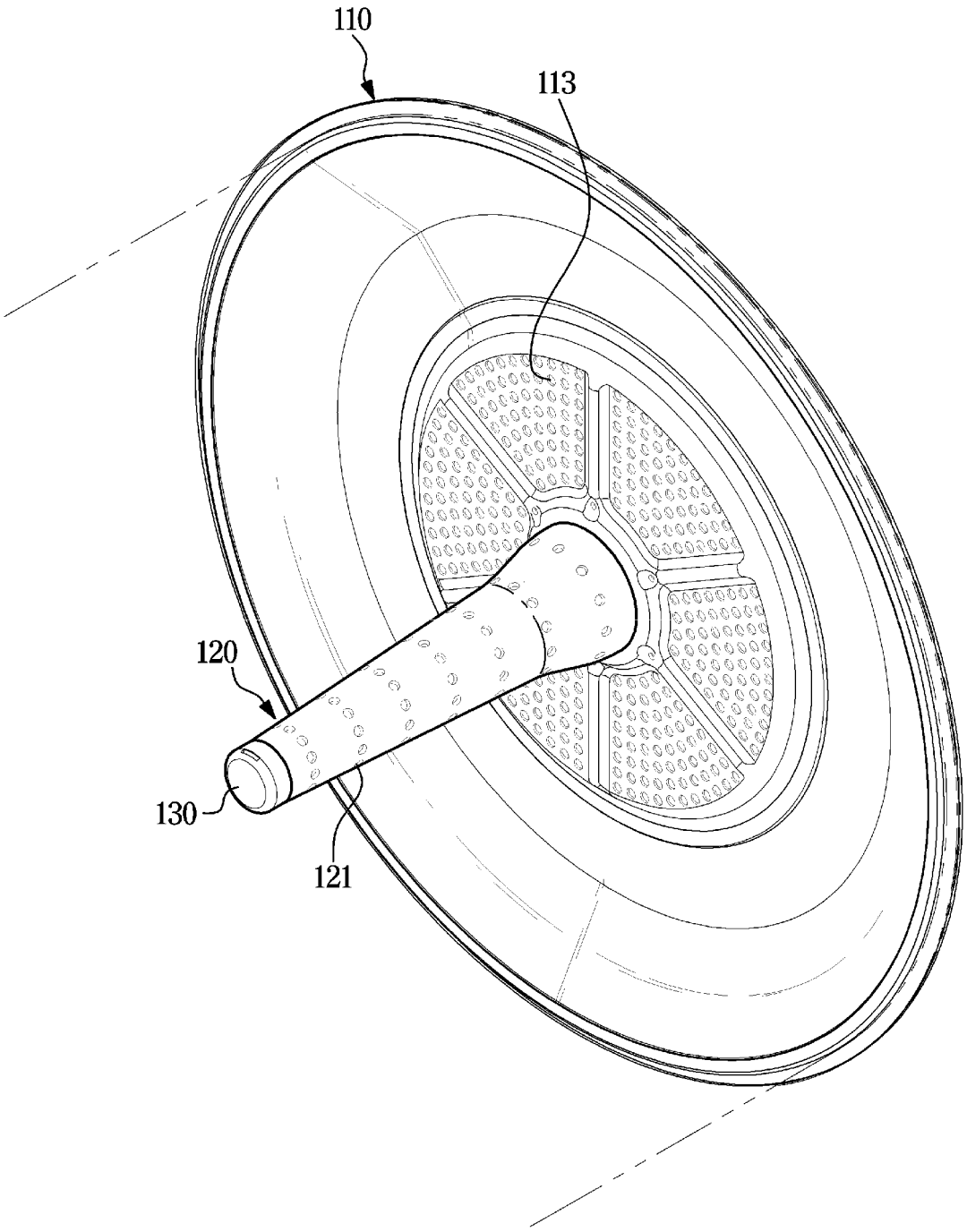
FIG. 12 is a view illustrating a state in which a hot air supply rod is coupled to a rear plate of a drum according to another embodiment of the disclosure.

FIG. 9 is a view illustrating a process in which a hot air supply rod is coupled to a rear plate of a drum according to another embodiment of the disclosure. FIG. 10 is a view illustrating a process in which a hot air supply rod is rotated to be coupled to a rear plate of a drum according to another embodiment of the disclosure. FIG. 11 is a view illustrating a process in which a first fixing protrusion of a hot air supply rod is inserted into a plurality of fixing holes formed on a rear plate and then rotated to be fixed according to another embodiment of the disclosure. FIG. 12 is a view illustrating a state in which a hot air supply rod is coupled to a rear plate of a drum according to another embodiment of the disclosure.

Referring to FIG. 9, a hot air supply rod 120 may be detachably coupled to a rear plate 110 of a drum 100. In the case of drying an object to be dried that fills the inside of the drum 100, the object to be dried may be hindered from being accommodated inside the drum 100 due to the hot air supply rod 120. In this case, the hot air supply rod 120 may be separated from the rear plate 110 and then an object to be dried may be introduced into the drum 100. While the hot air supply rod 120 is separated from the rear plate 110, the drier may be used by blocking a hot air supply hole 111 formed in the rear plate 110 with a cover 170. This will be described below.

The hot air supply rod 120 may include a plurality of first fixing protrusions 123 coupled to the rear plate 110. The rear plate 110 to which the hot air supply rod 120 is detachably coupled may include a plurality of fixing holes 115 provided for the plurality of first fixing protrusions 123 to be coupled thereto. The plurality of fixing holes 115 may be provided along a circumference of the hot air supply hole 111. Since the hot air supply rod 120 has the same configuration as that of the hot air supply rod 120 shown in FIG. 6 except for the plurality of first fixing protrusions 123 formed on the hot air supply rod 120 and the plurality of fixing holes 115 formed in the rear plate 110, description of other configurations will be omitted.

Referring to FIGS. 10 to 12, the hot air supply rod 120 may be coupled to the rear plate 110 by inserting the plurality of first fixing protrusions 123 into the plurality of fixing holes 115 formed in the rear plate 110 and rotating the hot air supply rod 120. As the hot air supply rod 120 is rotated, each of the plurality of first fixing protrusions 123 may be inserted into and fixed to a corresponding one of the plurality of fixing holes 115. To separate the hot air supply rod 120 from the rear plate 110, the hot air supply rod 120 may be rotated in the opposite direction to that when the hot air supply rod 120 is coupled to the rear plate 110, so that the hot air supply rod 120 may be separated from the rear plate 110.

Figure 13:
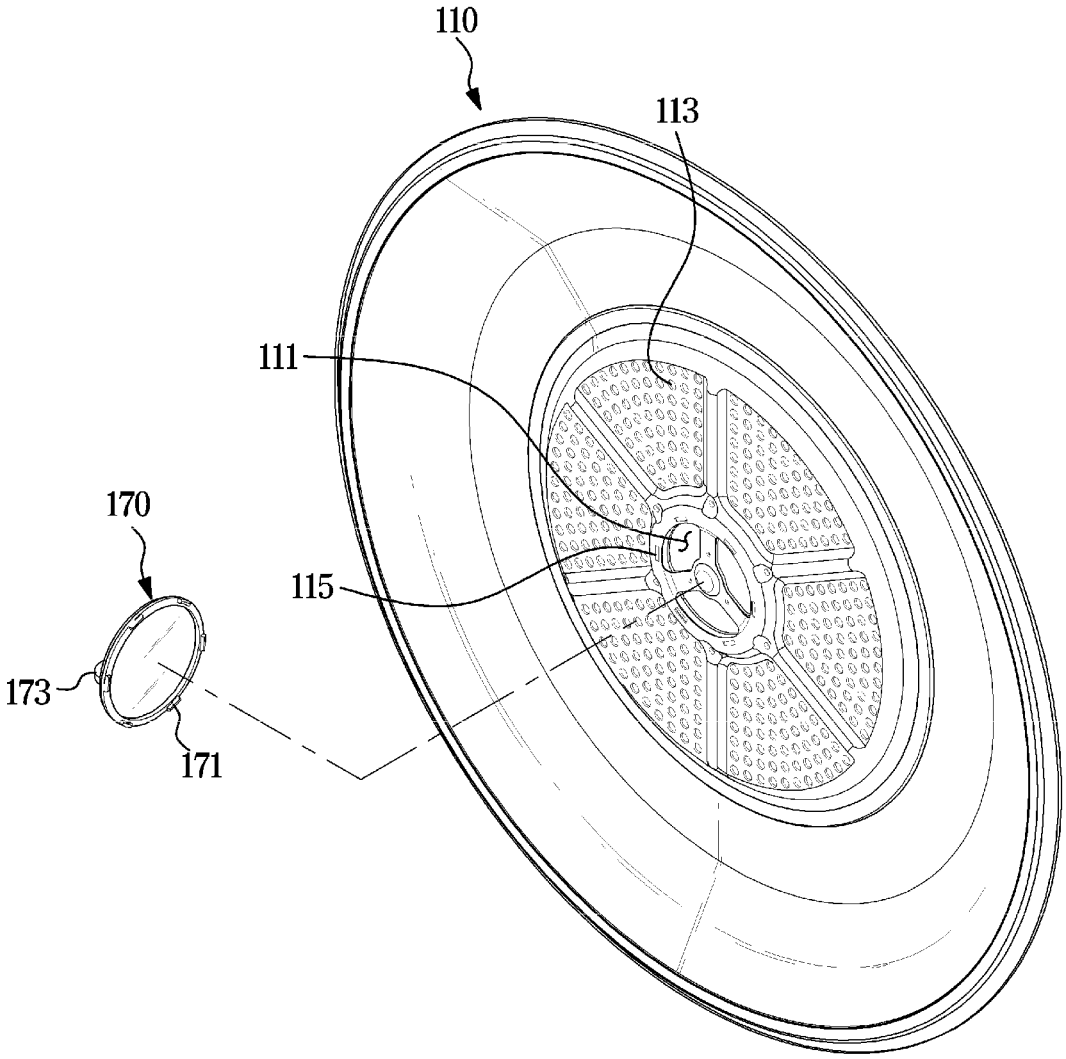
FIG. 13 is a view illustrating a state in which a cover is coupled to a rear plate of a drum according to another embodiment of the disclosure.
Figure 14:
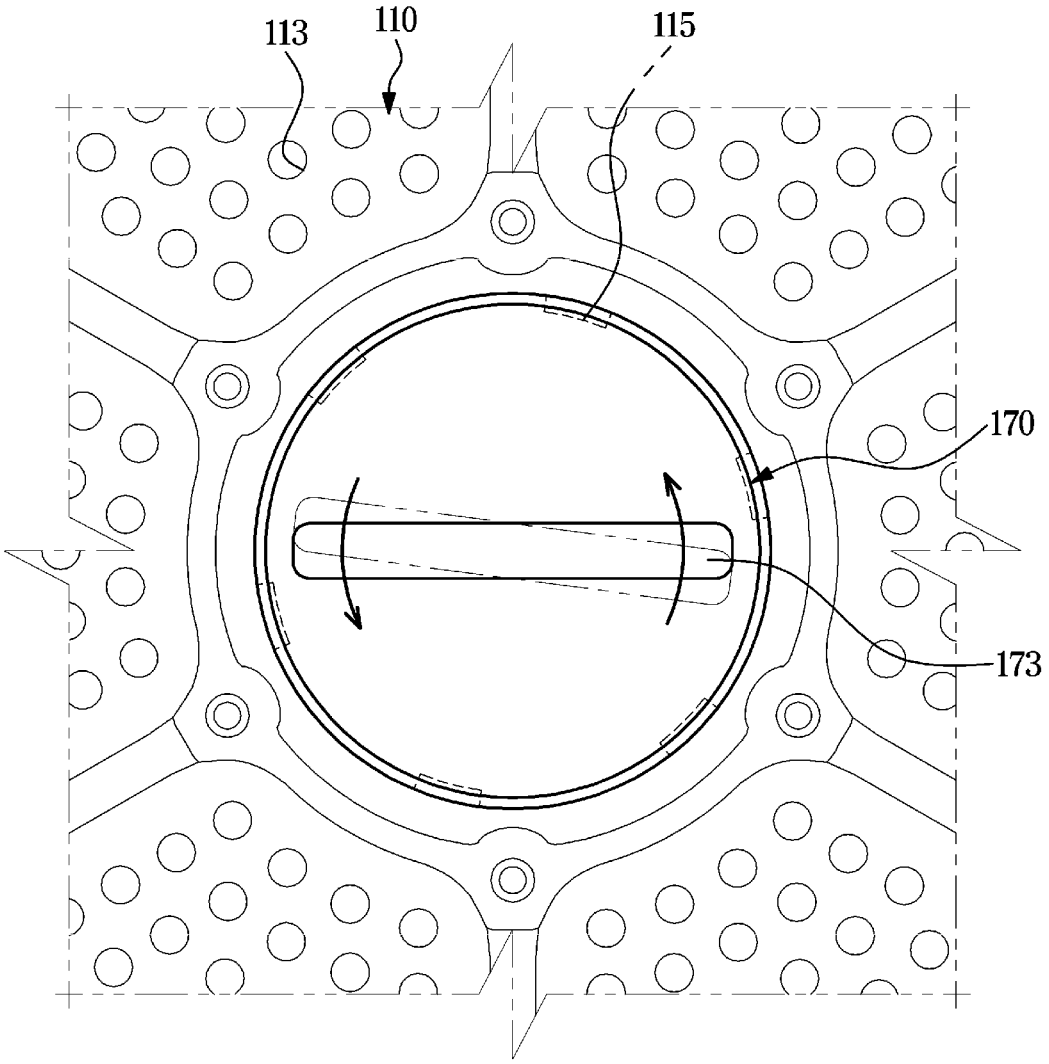
FIG. 14 is a view illustrating a process in which a cover is rotated to be coupled to a rear plate of a drum according to another embodiment of the disclosure.
Figure 15:
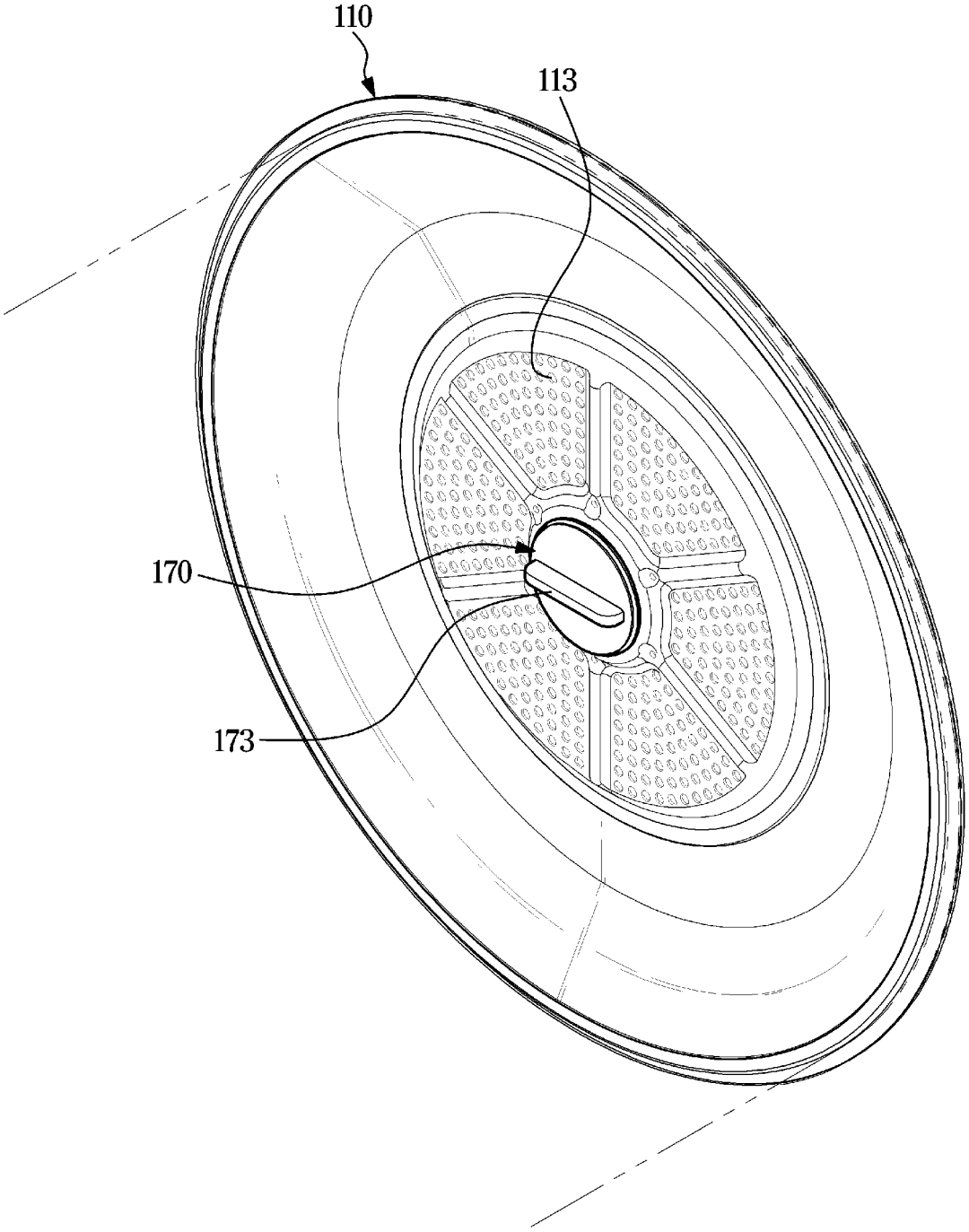
FIG. 15 is a view illustrating a state in which a cover is coupled to a rear plate of a drum according to another embodiment of the disclosure.

FIG. 13 is a view illustrating a state in which a cover is coupled to a rear plate of a drum according to another embodiment of the disclosure. FIG. 14 is a view illustrating a process in which a cover is rotated to be coupled to a rear plate of a drum according to another embodiment of the disclosure. FIG. 15 is a view illustrating a state in which a cover is coupled to a rear plate of a drum according to another embodiment of the disclosure.

Referring to FIG. 13, a cover 170 may be detachably coupled to a rear plate 110 of a drum 100. In the case of drying an object to be dried that that fills the inside of the drum 100, the object to be dried may be hindered from being accommodated inside the drum 100 due to the hot air supply rod 120. In this case, the hot air supply rod may be separated from the rear plate 110, and then an object to be dried may be introduced into the drum 100. While the hot air supply rod 120 is separated from the rear plate 110, the drier may be used by blocking the hot air supply hole 111 formed in the rear plate 110 with the cover 170 (see FIGS. 9 to 12).

The cover 170 may include a plurality of second fixing protrusions 171 coupled to the rear plate 110. The rear plate 110 to which the cover 170 is detachably coupled may include a plurality of fixing holes 115 allowing the plurality of second fixing protrusions 171 to be fixed thereto. The plurality of fixing holes 115 may be provided along a circumference of the hot air supply hole 111.

The cover 170 may include a handle 173 that may be gripped by a user when the cover 170 is coupled to or separated from the rear plate 110.

Referring to FIGS. 14 and 15, the cover 170 may be coupled to the rear plate 110 by inserting the plurality of second fixing protrusions 171 into the plurality of fixing holes 115 formed on the rear plate 110 and rotating the cover 170. As the cover 170 is rotated, each of the plurality of second fixing protrusions 171 may be inserted into and fixed to a corresponding one of the plurality of fixing holes 115. The configuration in which the plurality of second fixing protrusions 171 are fixed to the plurality of fixing holes 115 may be the same as that shown in FIG. 11. To separate the cover 170 from the rear plate 110, the cover 170 may be rotated in the opposite direction to that when the cover 170 is coupled to the rear plate 110 so that the cover 170 may be separated from the rear plate 110.

A specific shape and a specific direction of a drier have been described above with reference to the accompanying drawings, but the present disclosure may be variously modified and changed by those skilled in the art, and the modifications and changes should be interpreted as being included in the scope of the present disclosure.

What is claimed is:

1. A dryer comprising:

a cabinet;

a drum rotatable inside the cabinet, the drum being configured to accommodate an object to be dried; and a hot air supply device configured to supply hot air into the drum, wherein the drum includes:

a rear plate to be arranged on a rear side of the drum, the rear plate including a hot air supply hole through which hot air supplied from the hot air supply device flows toward the drum; and a hot air supply rod protruding along a direction toward a front side of the drum and through which the hot air from the hot air supply hole flows toward the drum, wherein the hot air supply rod includes:

a humidity sensor to be arranged on a front side of the hot air supply rod to measure humidity of the object which is accommodated in the drum to be dried; and a self-power generation device configured to generate power as a magnet rotatable together with the drum rotates while the drum is being rotated and to supply power generated to the humidity sensor.

2. The dryer of claim 1, wherein the self-power generation device includes:

a tunnel on the front side of the hot air supply rod such that the magnet rotates along a circumference of the tunnel, and a coil along the circumference of the tunnel such that the power is generated as the magnet rotates inside the tunnel.

3. The dryer of claim 2, wherein the tunnel has a ring shape.

4. The dryer of claim 3, wherein a plurality of coils including the coil are provided to be spaced apart from each other along the circumference of the tunnel.

5. The dryer of claim 3, wherein the coil is provided as one part along an entirety of the circumference of the tunnel.

6. The dryer of claim 1, wherein the hot air supply rod includes a plurality of flow holes that allow the hot air supplied toward the drum to flow at 360 degrees with respect to the hot air supply rod.

7. The dryer of claim 6, wherein the hot air supplied from the plurality of flow holes into the drum is supplied along a circumferential direction of the hot air supply rod.

8. The dryer of claim 1, wherein the hot air supply rod includes a housing, on the front side of the hot air supply rod, accommodates the humidity sensor and the self-power generation device.

9. The dryer of claim 8, wherein a printed circuit board (PCB) is between the self-power generation device and the humidity sensor to supply the power generated by the self-power generation device to the humidity sensor.

10. The dryer of claim 8, wherein the housing includes an opening to allow the humidity sensor to measure the humidity of the object to be dried.

11. The dryer of claim 1, wherein the hot air supply rod is coupleable to and detachable from the rear plate.

12. The dryer of claim 11, wherein the hot air supply rod includes a plurality of fixing protrusions coupleable to the rear plate, and the rear plate includes a plurality of fixing holes to allow the plurality of fixing protrusions to be fixed at a circumference of the hot air supply hole.

13. The dryer of claim 12, wherein the hot air supply rod is coupleable to the rear plate while the plurality of fixing protrusions are inserted into the plurality of fixing holes and the hot air supply rod is rotated such that the plurality of fixing protrusions are fixed to the plurality of fixing holes.

14. The dryer of claim 12, further comprising a cover coupleable to and detachable from the rear plate to cover the hot air supply hole in a state in which the hot air a supply rod is separated from the rear plate.

15. The dryer of claim 14, wherein the plurality of fixing protrusions are a plurality of first fixing protrusions and the cover includes a plurality of second fixing protrusions to be fixed to the plurality of fixing holes, and the cover is coupleable to the rear plate while the plurality of second fixing protrusions are inserted into the plurality of fixing holes and the cover is rotated such that the plurality of second fixing protrusions are fixed to the plurality of fixing holes.

* * * * *